US010281850B2

(12) United States Patent
Matsuda et al.

(10) Patent No.: US 10,281,850 B2
(45) Date of Patent: May 7, 2019

(54) FIXING DEVICE WITH NIP FORMATION PAD HAVING AN ABUTMENT REGION AND OPENING PORTIONS

(71) Applicants: Ryohei Matsuda, Kanagawa (JP); Ippei Fujimoto, Kanagawa (JP); Kenji Ishii, Kanagawa (JP); Hiroshi Yoshinaga, Chiba (JP); Takayuki Seki, Kanagawa (JP); Kazunari Sawada, Shizuoka (JP)

(72) Inventors: Ryohei Matsuda, Kanagawa (JP); Ippei Fujimoto, Kanagawa (JP); Kenji Ishii, Kanagawa (JP); Hiroshi Yoshinaga, Chiba (JP); Takayuki Seki, Kanagawa (JP); Kazunari Sawada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/980,123

(22) Filed: May 15, 2018

(65) Prior Publication Data

US 2018/0335733 A1 Nov. 22, 2018

(30) Foreign Application Priority Data

May 22, 2017 (JP) ..... 2017-100876

(51) Int. Cl.
*G03G 15/20* (2006.01)

(52) U.S. Cl.
CPC ..... *G03G 15/2017* (2013.01); *G03G 15/2053* (2013.01); *G03G 15/2064* (2013.01); *G03G 2215/2035* (2013.01)

(58) Field of Classification Search
CPC ..... G03G 15/2017
(Continued)

(56) References Cited

U.S. PATENT DOCUMENTS

2012/0251208 A1* 10/2012 Hasegawa ..... G03G 15/2017 399/329
2014/0153983 A1* 6/2014 Fujii ..... G03G 15/2053 399/329

(Continued)

FOREIGN PATENT DOCUMENTS

JP 2003-005572 1/2003
JP 2016-033636 3/2016

(Continued)

OTHER PUBLICATIONS

U.S. Appl. No. 15/783,199, filed Oct. 13, 2017, Hiroshi Yoshinaga, et al.

(Continued)

*Primary Examiner* — Quana Grainger
(74) *Attorney, Agent, or Firm* — Oblon, McClelland, Maier & Neustadt, L.L.P.

(57) ABSTRACT

A fixing device includes an endless fixing belt, a heat source, an opposed member, a nip formation pad, and a heat conductive member. The nip formation pad includes an abutment region, a first opening portion, and second opening portions. The abutment region includes a plurality of abutment surfaces abutting a first face of the heat conductive member. The first opening portion is disposed at a center of the abutment region to form a non-contact area at which the nip formation pad does not contact the heat conductive member. The abutment region includes an upstream abutment area and a downstream abutment area from the first opening portion in a direction of conveyance of a recording medium. The second opening portions divide at least one area of the upstream abutment area and the downstream abutment area into a plurality of portions in a longitudinal direction of the nip formation pad.

9 Claims, 7 Drawing Sheets

(58) Field of Classification Search
USPC ..... 399/329
See application file for complete search history.

(56) References Cited

U.S. PATENT DOCUMENTS

| | | | |
|---|---|---|---|
| 2015/0261155 | A1 | 9/2015 | Yoshiura et al. |
| 2016/0223961 | A1 | 8/2016 | Takagi et al. |
| 2016/0246228 | A1 | 8/2016 | Fujimoto et al. |
| 2016/0274510 | A1 | 9/2016 | Hase et al. |
| 2016/0274511 | A1 | 9/2016 | Ogino et al. |
| 2016/0274514 | A1 | 9/2016 | Ishii et al. |
| 2016/0334742 | A1 | 11/2016 | Kobashigawa et al. |
| 2016/0378027 | A1 | 12/2016 | Sawada et al. |
| 2017/0010570 | A1 | 1/2017 | Fujimoto et al. |
| 2017/0176907 | A1 | 6/2017 | Sawada et al. |
| 2017/0185009 | A1 | 6/2017 | Yoshinaga et al. |
| 2017/0185015 | A1 | 6/2017 | Yoshinaga et al. |
| 2017/0185020 | A1 | 6/2017 | Seki et al. |
| 2017/0185021 | A1 | 6/2017 | Seki et al. |
| 2017/0255147 | A1 | 9/2017 | Seki et al. |
| 2017/0261900 | A1 | 9/2017 | Sawada et al. |
| 2017/0364000 | A1 | 12/2017 | Seki et al. |
| 2018/0011432 | A1 | 1/2018 | Yoshinaga et al. |
| 2018/0017910 | A1 | 1/2018 | Sawada et al. |
| 2018/0059587 | A1 | 3/2018 | Sawada et al. |

FOREIGN PATENT DOCUMENTS

| | | |
|---|---|---|
| JP | 2016-133638 | 7/2016 |
| JP | 2016-173457 | 9/2016 |
| JP | 2016-212211 | 12/2016 |
| JP | 2016-218434 | 12/2016 |
| JP | 2017-021307 | 1/2017 |

OTHER PUBLICATIONS

U.S. Appl. No. 15/804,459, filed Nov. 6, 2017, Takashi Seto, et al.
U.S. Appl. No. 15/827,085, filed Nov. 30, 2017, Takayuki Seki, et al.
U.S. Appl. No. 15/924,631, filed Mar. 19, 2018, Ippei Fujimoto, et al.

* cited by examiner

FIXING DEVICE WITH NIP FORMATION PAD HAVING AN ABUTMENT REGION AND OPENING PORTIONS

CROSS-REFERENCE TO RELATED APPLICATIONS

This patent application is based on and claims priority pursuant to 35 U.S.C. § 119(a) to Japanese Patent Application No. 2017-100876, filed on May 22, 2017, in the Japan Patent Office, the entire disclosure of which is hereby incorporated by reference herein.

BACKGROUND

Technical Field

Embodiments of this disclosure relate to a fixing device and an image forming apparatus incorporating the fixing device.

Related Art

As a fixing device that fixes an image on a recording medium, such as a sheet of paper, a fixing device is generally known that uses an endless belt (fixing belt) with a low heat capacity as a fixing member to speed up and save energy of the device.

However, in the case of a configuration using a fixing belt with a low heat capacity, it is difficult to keep the temperature distribution uniform in the longitudinal direction of the fixing belt. For example, an uneven temperature rise may occur in non-sheet passing areas at longitudinal end portions of the fixing belt. That is, since sheets of various sizes are passed through the fixing device, non-sheet-passing areas are formed on both sides of the fixing belt in the longitudinal direction when a small-size sheet is passed. In a sheet passing area, heat is consumed to heat the sheet. However, in the non-sheet passing areas, heat is not absorbed by the sheet and is accumulated in the fixing belt and an opposed member opposed to the fixing belt. The temperature of a nip portion of the non-sheet passing area is higher than the temperature of a nip portion of the sheet passing area maintained at a predetermined temperature. As described above, there is a problem to level the temperature distribution in the longitudinal direction of the fixing belt.

SUMMARY

In an aspect of the present disclosure, there is provided a fixing device that includes an endless fixing belt, a heat source, an opposed member, a nip formation pad, and a heat conductive member. The heat source heats the fixing belt. The opposed member is disposed at an outer circumferential surface side of the fixing belt and opposed to the fixing belt. The nip formation pad is disposed at an inner circumferential surface side of the fixing belt, to form a fixing nip between the fixing belt and the opposed member. The heat conductive member is disposed between the nip formation pad and the fixing belt. The heat conductive member has a first face abutting the nip formation pad and a second face abutting an inner circumferential surface of the fixing belt. The nip formation pad includes an abutment region, a first opening portion, and a plurality of second opening portions. The abutment region includes a plurality of abutment surfaces that abuts the first face of the heat conductive member. The first opening portion is disposed at a center of the abutment region to form a non-contact area at which the nip formation pad does not contact the heat conductive member. The abutment region includes an upstream abutment area and a downstream abutment area. The upstream abutment area is disposed at an upstream side from the first opening portion in a direction of conveyance of a recording medium. The downstream abutment area is disposed at a downstream side from the first opening portion in the direction of conveyance of the recording medium. The plurality of second opening portions divides at least one area of the upstream abutment area and the downstream abutment area into a plurality of portions in a longitudinal direction of the nip formation pad.

In another aspect of the present disclosure, there is provided an image forming apparatus comprising the fixing device.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein:

FIG. 10A is an illustration of the nip formation pad according to an embodiment of the present disclosure, FIG. 10B is a graph of a distribution of nip surface pressure in the embodiment of FIG. 10A, and FIG. 10C is a cross sectional view of the nip formation pad cut along line D1-D1 in FIG. 10A;

FIG. 11A is an illustration of the nip formation pad according to an embodiment of the present disclosure, FIG. 11B is a graph of a distribution of heat distribution amount of the heat source in the embodiment of FIG. 11A, and FIG. 11C is a cross sectional view of the nip formation pad cut along line D2-D2 in FIG. 11A;

FIG. 13A is an illustration of a nip formation pad according to an embodiment of the present disclosure, FIG. 13B is a graph of a distribution of nip surface pressure in the embodiment of FIG. 13A, and FIG. 13C is a cross sectional view of the nip formation pad cut along line D4-D4 in FIG. 13A.

Figure 1:
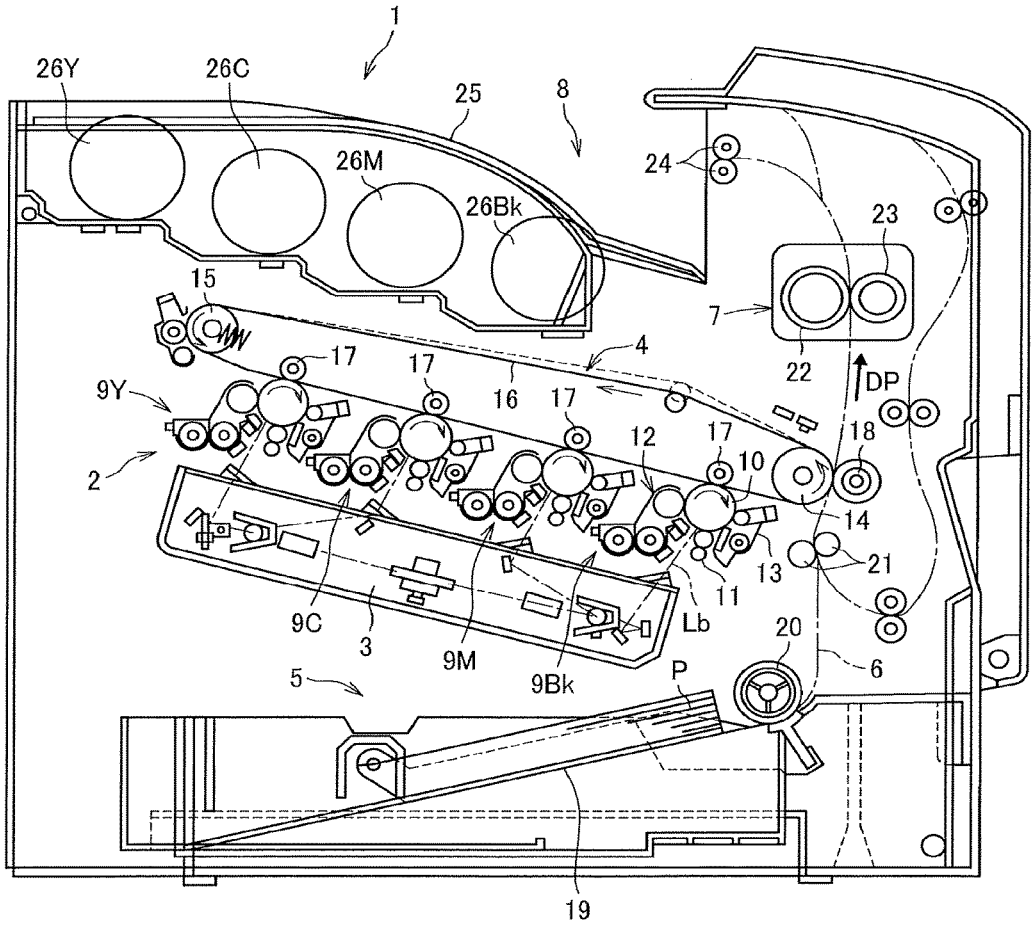
FIG. 1 is a schematic view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, the details of each embodiment will be described with reference to the attached drawings. In describing the specification and the drawings according to the respective embodiments, the same reference numerals will be given to the constituent elements having substantially the same functional arrangement to omit redundant explanation.

A description is provided of embodiments of the present disclosure with reference to attached drawings. Identical reference numerals are assigned to identical components or equivalents and a description of those components is simplified or omitted.

FIG. 1 is a cross-sectional view of an image forming apparatus 1 according to an embodiment of the present disclosure. As illustrated in FIG. 1, the image forming apparatus 1 includes an image forming device 2 disposed in a center portion of the image forming apparatus 1. The image forming device 2 includes four process units 9Y, 9M, 9C, and 9Bk (collectively referred to as process units 9) removably installed in the image forming apparatus 1. The process units 9Y, 9M, 9C, and 9Bk have substantially the same structures except that the process units 9Y, 9M, 9C, and 9Bk contain developers (e.g., yellow, magenta, cyan, and black toners) in different colors, that is, yellow (Y), magenta (M), cyan (C), and black (Bk) corresponding to color separation components of a color image, respectively.

Each of the process units 9 includes, for example, a photoconductive drum 10 that is a drum-shaped rotator to bear toner as a developer on a surface of the photoconductive drum 10, a charging roller 11 to uniformly charge the surface of the photoconductive drum 10, a developing device 12 including a developing roller to supply toner to the surface of the photoconductive drum 10, and a cleaning device 13 to remove residual toner after transfer from the photoconductive drum 10.

An exposure device 3 is disposed below the process units 9Y, 9M, 9C, and 9Bk. The exposure device 3 emits a laser beam Lb according to image data.

A transfer device 4 is disposed above the image forming device 2. The transfer device 4 includes, e.g., a drive roller 14, a driven roller 15, an endless intermediate transfer belt 16 entrained rotatably around the drive roller 14 and the driven roller 15, primary transfer rollers 17 facing the photoconductive drums 10 of the process units 9 via the intermediate transfer belt 16, and a secondary transfer roller 18. The four primary transfer rollers 17 are pressed against an inner circumferential surface of the intermediate transfer belt 16, forming four primary transfer nips between the four photoconductive drums 10 and the intermediate transfer belt 16, respectively.

The secondary transfer roller 18 faces the drive roller 14 via the intermediate transfer belt 16, and The secondary transfer roller 18 is pressed against an outer circumferential surface of the intermediate transfer belt 16, forming a secondary transfer nip between the secondary transfer roller 18 and the intermediate transfer belt 16.

A sheet feeder 5 is disposed at a lower portion of the image forming apparatus 1. The sheet feeder 5 includes a paper tray 19 that loads a plurality of sheets P serving as recording media and a feed roller 20 that picks up and feeds a sheet P from the paper tray 19 toward the secondary transfer nip formed between the secondary transfer roller 18 and the intermediate transfer belt 16.

The sheet P are conveyed through a conveyance passage 6 from the sheet feeder 5 toward an ejection device 8. Pairs of conveyance rollers including a pair of registration rollers 21 are disposed along the conveyance passage 6.

A fixing device 7 includes, for example, a fixing belt 22 heated by a heating source and a pressure roller 23 as an opposed member to press the fixing belt 22.

An ejection device 8 is disposed in a most downstream part of the conveyance passage 6 in a sheet conveyance direction DP. The ejection device 8 includes a pair of ejection rollers 24 to eject the sheet P outside and an ejection tray 25 to receive the sheet P ejected by the pair of ejection rollers 24.

Toner bottles 26Y, 26C, 26M, and 26Bk are removably installed in an upper portion of the image forming apparatus 1 and replenished with yellow, cyan, magenta, and black toners, respectively. Yellow, cyan, magenta, and black toners are supplied from the toner bottles 26Y, 26C, 26M, and 26Bk to the developing devices 12 through supply passages interposed between the toner bottles 26Y, 26C, 26M, and 26Bk and the developing devices 12, respectively.

With reference to FIG. 1, a description is provided of an image forming operation performed by the image forming apparatus 1 having the construction described above.

As the image forming apparatus 1 receives a print job and starts an image forming operation, the exposure device 3 emits laser beams onto the outer circumferential surfaces of the photoconductive drums 10 of the process units 9Y, 9C, 9M, and 9Bk, respectively, according to image data, thus forming electrostatic latent images on the photoconductive drums 10. The image data used to expose the respective photoconductive drums 10 is monochrome image data produced by decomposing a desired full color image into yellow, cyan, magenta, and black image data. The drum-shaped developing rollers of the developing devices 12 supply yellow, magenta, cyan, and black toners stored in the developing devices 12 to the electrostatic latent images formed on the photoconductive drums 10, visualizing the electrostatic latent images as developed visible images, that is, yellow, magenta, cyan, and black toner images, respectively.

In the transfer device 4, the intermediate transfer belt 16 is rotated by the rotation driving of the drive roller 14. A power supply applies a constant voltage or a constant current control voltage having a polarity opposite a polarity of the charged toner to the primary transfer rollers 17. Accordingly, a transfer electric field is produced at each of the primary transfer nips. The yellow, cyan, magenta, and black toner images are primarily transferred from the photoconductive drums 10 onto the intermediate transfer belt 16 successively at the primary transfer nips such that the yellow, cyan, magenta, and black toner images are superimposed on a same position on the intermediate transfer belt 16.

On the other hand, as the image forming operation starts, the feed roller 20 of the sheet feeder 5 disposed in the lower portion of the image forming apparatus 1 is driven and rotated to feed a sheet P from the paper tray 19 toward the pair of registration rollers 21 through the conveyance passage 6. The pair of registration rollers 21 conveys the sheet P sent to the conveyance passage 6 by the feed roller 20 to the secondary transfer nip between the secondary transfer roller 18 and the drive roller 14 at a proper time. The secondary transfer roller 18 is applied with a transfer voltage having a polarity opposite a polarity of the charged yellow, cyan, magenta, and black toners of the yellow, cyan, magenta, and black toner images on the intermediate transfer belt 16, thus creating a transfer electric field at the secondary transfer nip. The transfer electric field created at the secondary transfer nip secondarily transfers the yellow, cyan, magenta, and black toner images formed on the intermediate transfer belt 16 onto the sheet P collectively, thus forming a full color toner image on the sheet P.

The sheet P bearing the full color toner image is conveyed to the fixing device 7 in which the fixing belt 22 and the pressure roller 23 fix the full color toner image on the sheet P under heat and pressure. Then, the sheet P on which the toner image is fixed is separated from the fixing belt 22, conveyed by the pairs of conveyance rollers, and is ejected to the ejection tray 25 by the pair of ejection rollers 24 in the ejection device 8.

The above description relates to the image forming operation of the image forming apparatus 1 to form the full color toner image on the sheet P. Alternatively, the image forming apparatus 1 may form a monochrome toner image with any one of the four process units 9Y, 9C, 9M, and 9Bk or may form a bicolor or tricolor toner image with two or three of the process units 9Y, 9C, 9M, and 9Bk.

Figure 2:
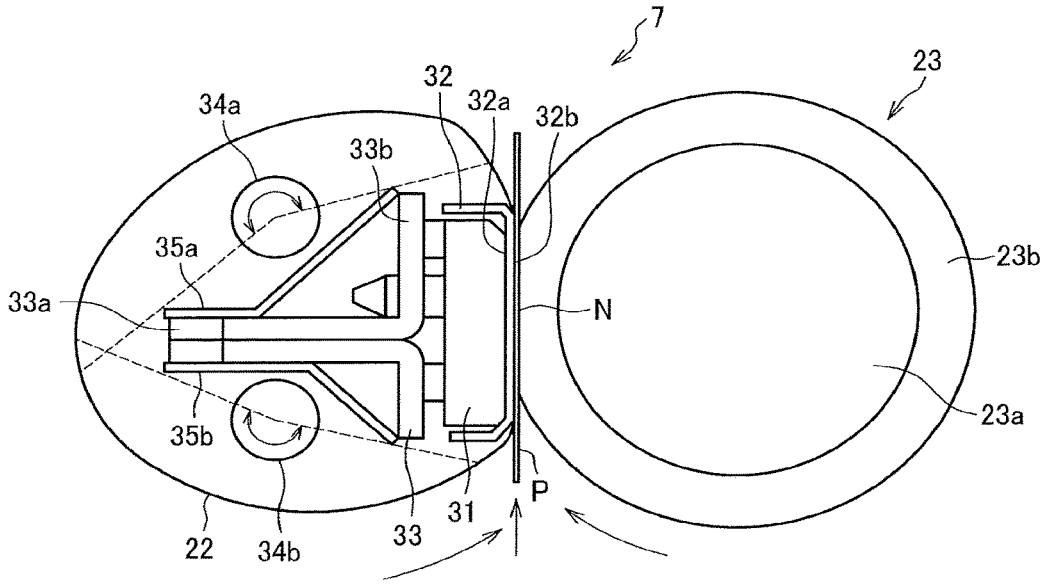
FIG. 2 is a cross-sectional view of a fixing device according to an embodiment of the present disclosure.

Next, a more specific configuration of the fixing device 7 is described with reference to FIG. 2. As illustrated in FIG. 2, the fixing device 7 includes, for example, an endless fixing belt 22 capable of running around, a pressure roller 23 facing the fixing belt 22, a nip formation pad 31 forming a fixing nip N between the fixing belt 22 and the pressure roller 23, a highly-heat-conductive member 32 provided between the fixing belt 22 and the nip formation pad 31, a stay 33 supporting the nip formation pad 31, heaters 34*a* and 34*b* as heating sources, and reflectors 35*a* and 35*b*.

The fixing belt 22 is an endless belt or film made of metal, such as nickel and stainless steel (SUS), or resin, such as polyimide. The fixing belt 22 includes a base layer and a release layer. The release layer constituting an outer surface layer is made of perfluoro alkoxy (PFA), polytetrafluoroethylene (PTFE), or the like to facilitate separation of toner of a toner image on the sheet S from the fixing belt 22, thus preventing the toner of the toner image from adhering to the fixing belt 22. An elastic layer may be sandwiched between the base layer and the release layer and made of silicone rubber or the like. If the fixing belt 22 does not incorporate the elastic layer, the fixing belt 22 has a decreased thermal capacity that improves fixing property of being heated quickly to a desired fixing temperature at which the toner image is fixed on the sheet P. However, as the pressure roller 23 and the fixing belt 22 sandwich and press an unfixed toner image on the sheet P passing through the fixing nip N, minute surface irregularities of the fixing belt 22 may be transferred onto the toner image on the sheet P, resulting in variation in gloss of the solid toner image that may appear as an orange peel image on the sheet P. To address this circumstance, the elastic layer made of silicone rubber has a thickness not smaller than about 100 micrometers. Due to the deformation of the silicone rubber layer, minute irregularities are absorbed and the orange peel image can be improved.

The pressure roller 23 includes a core metal 23*a*, an elastic rubber layer 23*b*, and a release layer (PFA or PTFE layer) provided on the surface of the elastic rubber layer 23*b*. The pressure roller 23 may be a hollow roller or a solid roller. If the pressure roller 23 is a hollow roller, a heat source, such as a halogen heater, may be disposed inside the hollow roller. The elastic rubber layer 23*b* may be made of solid rubber. Alternatively, if no heater is disposed inside the pressure roller 23, the elastic rubber layer 23*b* may be made of sponge rubber. The sponge rubber is more preferable than the solid rubber because the sponge rubber has an increased insulation that draws less heat from the fixing belt 22.

The pressure roller 23 is pressed against the fixing belt 22 by a pressing member, such as a spring. Accordingly, the elastic layer of the pressure roller 23 is compressed, and the fixing nip N of a predetermined width is formed.

A drive source (e.g., a motor) disposed inside a body of the image forming apparatus 1 drives and rotates the pressure roller 23. As the driver drives and rotates the pressure roller 23, a driving force of the driver is transmitted from the pressure roller 23 to the fixing belt 22 at the fixing nip N, thus rotating the fixing belt 22 in accordance with rotation of the pressure roller 23 by friction between the pressure roller 23 and the fixing belt 22. The fixing belt 22 is sandwiched between the fixing nip N and rotated, and is guided by side plates, which are disposed at both lateral sides of the fixing belt 22, in an area except for the fixing nip N to travel around.

The nip formation pad 31, the highly-heat conductive member 32, the stay 33, the heaters 34*a* and 34*b*, and the reflectors 35*a* and 35*b* are provided at an inner circumferential surface side of the fixing belt 22. In addition, the nip formation pad 31, the highly-heat conductive member 32, and the stay 33 are all provided to extend in a longitudinal direction of the fixing belt 22 (a front-and-back direction with respect to a sheet surface of a paper on which FIG. 2 is printed). The longitudinal direction of the fixing belt 22 is the same direction as a longitudinal direction of the nip formation pad 31, and these directions are also simply referred to as the longitudinal direction in the following description.

The nip formation pad 31 supports the fixing belt 22 from a back side of the fixing belt 22, and forms the fixing nip N. The nip formation pad 31 is made of a heat-resistant material having an increased mechanical strength with a heatproof temperature of 200° C. or higher. More specifically, the nip formation pad 31 is made of a heat-resistant resin, such as polyimide (PI) resin, polyether ether ketone (PEEK) resin, or one of those resins reinforced with glass fibers. Such a configuration can prevent the nip formation pad 31 from being thermally deformed at temperatures in a fixing temperature range desirable to fix a toner image on a sheet S, and retain the shape of the fixing nip N and the quality of the toner image formed on the sheet S.

The highly-heat-conductive member 32 is made of a material having high thermal conductivity. In the present embodiment, the highly-heat-conductive member 32 is made of, for example, copper, aluminum, or silver. It is preferable that the highly-heat-conductive member 32 is made of copper in a comprehensive view of manufacturing costs, availability, thermal conductivity, and processing.

A first surface 32*a* of the highly-heat-conductive member 32 on one side in a thickness direction of the highly-heat-conductive member 32 abuts the nip formation pad 31. The highly-heat-conductive member 32 is fitted to the nip formation pad 31 by, for example, claws or the like, and is integrated with the nip formation pad 31 as a single unit.

A second surface 32*b* of the highly-heat-conductive member 32 on the other side in a thickness direction of the highly-heat-conductive member 32 abuts the inner circumferential surface of the fixing belt 22. The second surface 32*b* is a nip forming surface of the highly-heat-conductive member 32, and is formed in a flat shape. In some embodiments, the second surface 32*b* may be formed in a concave shape or another shape with respect to a sheet conveyance direction. By forming the nip forming surface of the highly-heat-conductive member 32 in a concave shape, an ejected direction of a leading edge of the sheet P becomes closer to the pressure roller 23, thus enhancing the separation performance and reducing the occurrence of jamming.

The highly-heat-conductive member 32 abuts the inner circumferential surface of the fixing belt 22. The heat of the fixing belt 22 is transmitted and the transmitted heat is moved in the longitudinal direction of the highly-heat-conductive member 32 (the front-and-back direction with respect to a sheet surface of a paper on which FIG. 2 is printed). Such a configuration can equalize the temperature distribution in the longitudinal direction of the fixing belt 22. For example, even when a small size sheet passes through the fixing device 7, the temperature difference between both a sheet passing area of the fixing belt 22 and non-sheet passing areas in longitudinal ends of the fixing belt 22 can be reduced.

Further, one end and the other end of the highly-heat-conductive member 32 in the sheet conveyance direction are bent toward the stay 33 and extended toward the stay 33. As described above, the highly-heat-conductive member 32 has the portions extending in a direction (left direction in FIG. 2) in which the highly-heat-conductive member 32 receives a nip surface pressure. Thus, increasing a cross sectional area of the highly-heat-conductive member 32 in the direction can enhance the mechanical strength of the highly-heat-conductive member 32, thus obtaining the rigidity with respect to deflection and twist. Note that the above-mentioned twist means that, for example, a slight time difference in the rotation operation occurs between a drive source side and an opposite side in the longitudinal direction of the pressure roller 23, so that the magnitude of the pressure applied to the highly-heat-conductive member 32 becomes nonuniform in the longitudinal direction and causes a twist occurring in the highly-heat-conductive member 32.

The stay 33 is formed in a T shape in cross section. The stay 33 has an upright portion 33*a* erected on a side opposite to a side of the fixing nip N and a horizontal portion 33*b* extending in the sheet conveyance direction. The stay 33 supports the nip formation pad 31 from a back side of the nip formation pad 31 and prevents the nip formation pad 31 from being deflected by pressure from the pressure roller 23. Such a configuration can form a uniform nip width in the longitudinal direction of the fixing belt 22. It is preferable that the nip formation pad 31 abuts the stay 33 by a protrusion, such as a boss, extending toward the stay 33. As a result, the contact area between the nip formation pad 31 and the stay 33 can be reduced, and the transfer of heat from the nip formation pad 31 to the stay 33 can be reduced.

One of the heaters 34*a* and 34*b* has a heat generation area in a longitudinal center portion corresponding to a small-size paper sheet and the other of the heaters 34*a* and 34*b* has heat generation areas in both longitudinal end portions corresponding to a large-size paper sheet. The heaters 34*a* and 34*b* are, for example, halogen heaters, and the fixing belt 22 is heated from the inner circumferential surface side of the fixing belt 22 by radiant heat. Note that the heating source may be an induction heating device, a resistance heating element, a carbon heater, or the like.

Both ends of each of the stay 33 and the heaters 34*a* and 34*b* in the longitudinal end are supported by, for example, side plates of the fixing device 7.

The power supply situated inside the image forming apparatus 1 controls the output of the heaters 34*a* and 34*b* so that the heaters 34*a* and 34*b* generate heat. The output control is performed based on the temperature of the outer circumferential surface of the fixing belt 22 detected by a temperature sensor disposed opposite the outer circumferential surface of the fixing belt 22. By such output control of the heaters 34*a* and 34*b*, the surface temperature of the fixing belt 22 can be set to a desired temperature.

The reflectors 35*a* and 35*b* are disposed between the stay 33 and the heaters 34*a* and 34*b*, respectively, and are provided so as to cover the upright portion 33*a*. The reflectors 35*a* and 35*b* reflect the heat transmitted from the heaters 34*a* and 34*b* to the stay 33 toward the fixing belt 22. Such a configuration can prevent unnecessary heat transmission to the stay 33 and can effectively heat the fixing belt 22. Alternatively, instead of the reflectors 35*a* and 35*b*, an opposed face of the stay 33 disposed opposite the heaters 34*a* and 34*b* may be treated with insulation or mirror finish. With such a configuration, a similar, even if not the same, effect can be obtained.

Figure 3:
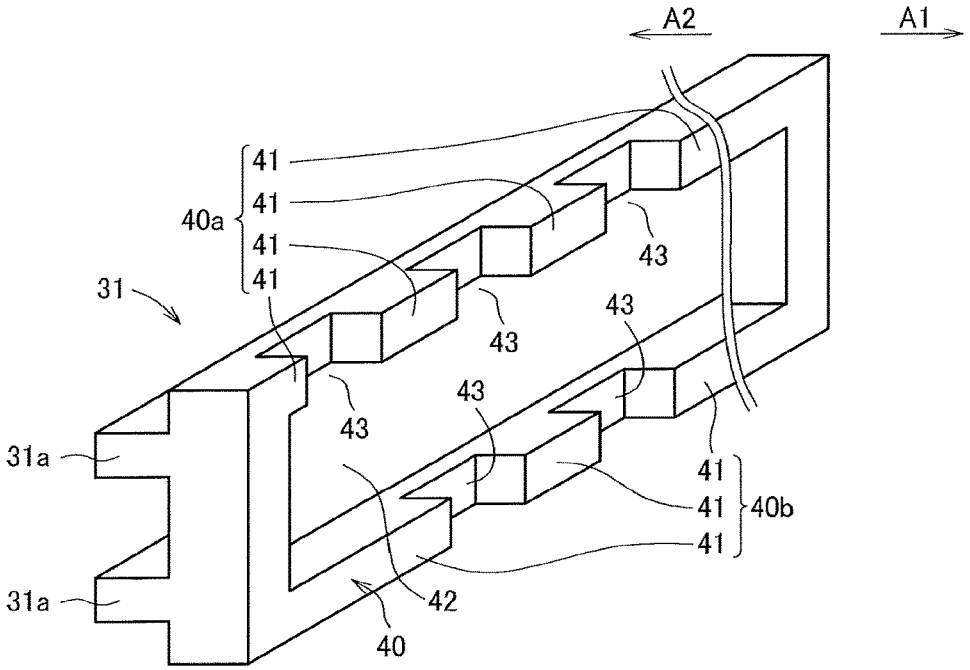
FIG. 3 is a perspective view of a nip formation pad according to an embodiment of the present disclosure.

A description is provided of a detailed construction of the nip formation pad. FIG. 3 is a perspective view of the nip formation pad 31. As illustrated in FIG. 3, the nip formation pad 31 of the present embodiment has an abutment region 40 that abuts against the highly-heat-conductive member 32 on the side of the fixing belt 22 (a side indicated by arrow A1).

The abutment region 40 has a plurality of abutment surfaces 41 to abut the highly-heat-conductive member 32. A first opening portion 42 to form a non-contact area with the highly-heat-conductive member 32 is disposed in a center of the abutment region 40. Further, the nip formation pad 31 has two protrusions 31*a* on a side facing the stay 33 (the side indicated by arrow A2 in FIG. 2). The protrusions 31*a* extend in the longitudinal direction and protrude toward the stay 33 (see FIG. 2). The nip formation pad 31 abuts the stay 33 by the protrusions 31*a*.

The abutment region 40 has a downstream abutment area 40*a* and an upstream abutment area 40*b* that are respectively provided on the downstream side and the upstream side of the first opening portion 42 in the sheet conveyance direction. Further, the abutment region 40 is provided with a plurality of second opening portions 43. The downstream abutment area 40*a* and the upstream abutment area 40*b* are discontinuously divided by the plurality of second opening portions 43 in the longitudinal direction of the nip formation pad 31. The first opening portion 42 and the plurality of second opening portions 43 are continuously provided to form one large opening portion.

The first opening portion 42 and the second opening portions 43 are provided in partial regions of the nip formation pad 31 in the thickness direction of the nip formation pad 31. The nip formation pad 31 is continuous in the longitudinal direction at the side facing the stay 33 (the side indicated by arrow A2).

Figure 4:
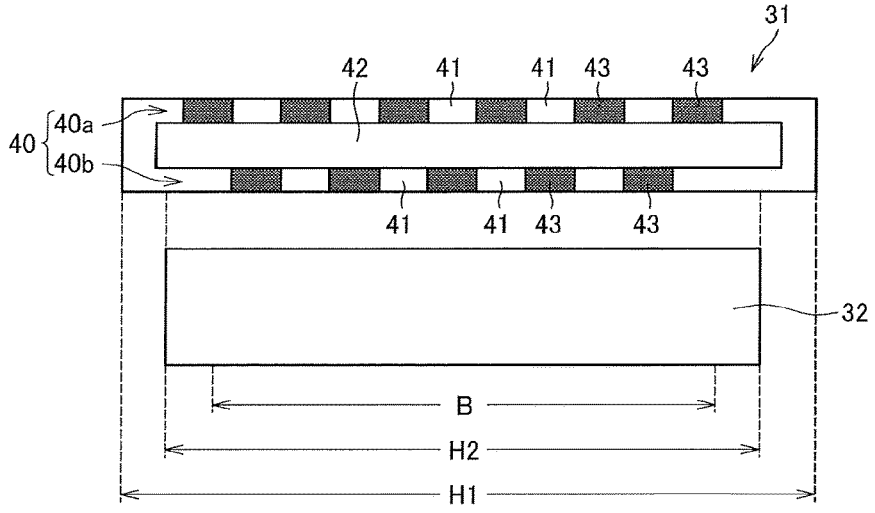
FIG. 4 is an illustration of a positional relationship between a nip formation pad and a highly-heat-conductive member in a longitudinal direction.

As illustrated in FIG. 4, the width H1 in the longitudinal direction of the nip formation pad 31 is greater than the width H2 of the highly-heat-conductive member 32. The width H1 and the width H2 are provided so as to encompass a sheet passing area B. By providing the nip formation pad 31 over the entire sheet passing area B, the fixing belt 22 and the pressure roller 23 (see FIG. 2) are pressed against each other in the entire sheet passing area B to form the fixing nip N. Further, by providing the highly-heat-conductive member 32 over the entire sheet passing area B, heat transfer in the longitudinal direction of the fixing belt 22 can be promoted in the entire sheet passing area B, thus causing the temperature of the fixing belt 22 to uniform in the longitudinal direction.

While the above-described effect can be obtained by providing the highly-heat-conductive member 32, the amount of heat transferred from the fixing belt 22 to the highly-heat-conductive member 32 might increase. Consequently, it might take a longer time or power to raise the temperature of the fixing belt 22 to the fixing temperature.

Hence, in the present embodiment, the nip formation pad 31 has the first opening portion 42 and the second opening portions 43, thus reducing the contact area between the nip formation pad 31 and the highly-heat-conductive member 32. Further, by providing the first opening portion 42 and the second opening portions 43, an air layer is formed between the nip formation pad 31 and the highly-heat-conductive member 32, thus achieving a certain heat insulating effect between the nip formation pad 31 and the highly-heat-conductive member 32. Such a configuration can reduce the amount of heat transmitted from the highly-heat-conductive member 32 to the nip formation pad 31 and the amount of heat of the fixing belt 22 absorbed by the highly-heat-conductive member 32. Therefore, it is possible to obtain the effect of leveling the temperature distribution in the longitudinal direction of the fixing belt 22 by the highly-heat-conductive member 32 and to effectively heat the fixing belt 22. Therefore, it is possible to shorten the warm-up time of the fixing device 7 at the time of starting the image forming apparatus 1, reduce the power consumption for raising the temperature of the fixing belt 22 to the fixing temperature, and save energy in the image forming apparatus 1. Particularly in the present embodiment, by providing the second opening portions 43 at a plurality of locations, the portions in which the highly-heat-conductive member 32 are not in contact with the nip formation pad 31 are intermittently disposed in the longitudinal direction, and each of the second opening portions 43 in the longitudinal direction can be reduced. Therefore, it is possible to prevent an increase in the width per one of the non-contact areas formed by the second opening portions 43 and reduce the deflection of the highly-heat-conductive member 32.

Figure 5A:
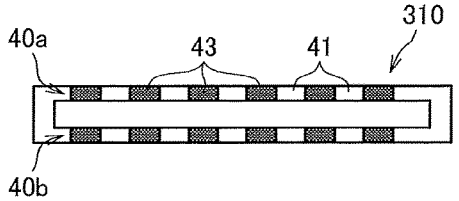
FIG. 5A is a side view of a configuration of a nip formation pad different from the nip formation pad according to an embodiment of the present disclosure.

In the portions where the second opening portions 43 are disposed, the nip formation pad 31 does not support the highly-heat-conductive member 32. Accordingly, the nip surface pressure decreases at the positions of the fixing nip N corresponding to the second opening portions 43. Accordingly, in a configuration in which the second opening portions 43 are located at the same position in the longitudinal direction in the downstream abutment area 40*a* and the upstream abutment area 40*b* like a nip formation pad 310 illustrated in FIGS. 5A and 5C which is different from the nip formation pad 31 in the present embodiment, the difference in the nip surface pressure PR increases between the positions at which the second opening portions 43 are disposed and the positions at which the second opening portions 43 are not disposed.

Figure 5B:
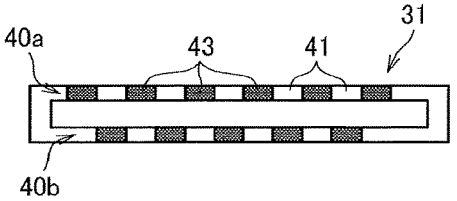
FIG. 5B is a side view of a configuration of the nip formation pad according to an embodiment of the present disclosure.
Figure 5C:
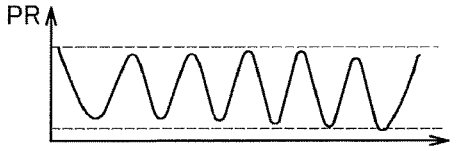
FIG. 5C is a graph of a distribution of nip surface pressure in a longitudinal direction of the nip formation pad illustrated in FIG. 5A.
Figure 5D:
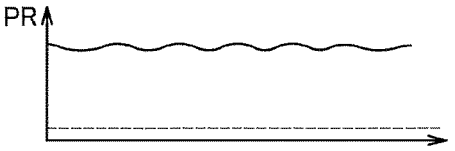
FIG. 5D is a graph of a distribution of nip surface pressure in a longitudinal direction of the nip formation pad illustrated in FIG. 5B.

On the other hand, in the present embodiment, as illustrated in FIGS. 5B and 5D, the second opening portions 43 disposed in the downstream abutment area 40*a* and the second opening portions 43 disposed in the upstream abutment area 40*b* are alternately arranged in the longitudinal direction. Such a configuration can level the nip surface pressure PR in the longitudinal direction. Accordingly, unevenness of the nip surface pressure between places can be eliminated, gloss unevenness or the like caused by a reduction in the nip surface pressure can be prevented, and degradation of the image quality in the fixing operation can be prevented.

As described above, according to the configuration of the present embodiment, the contact area between the nip formation pad 31 and the highly-heat-conductive member 32 can be reduced to reduce the heat transfer amount from the highly-heat-conductive member 32 to the nip formation pad 31. The decrease in nip pressure due to the reduction in the contact area of the nip formation pad 31 and the highly-heat-conductive member 32 can be effectively reduced.

Figure 6A:
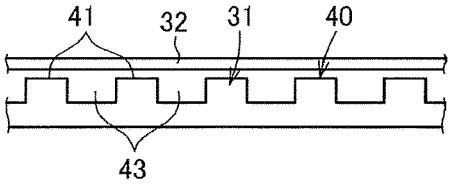
FIG. 6A is an illustration of a shape of an edge of a nip formation pad according to an embodiment of the present disclosure.
Figure 6B:
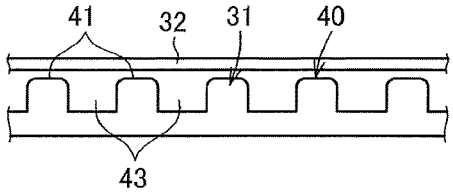
FIG. 6B is an illustration of a shape of an edge of a nip formation pad according to an embodiment of the present disclosure.

As illustrated in FIG. 6A, an edge forming the abutment surface 41 of the nip formation pad 31 may have a right angle, or may be an R shape as illustrated in FIG. 6B. In FIGS. 6A and 6B, the nip formation pad 31 and the highly-heat-conductive member 32 are illustrated apart from each other for the sake of convenience. However, actually, the nip formation pad 31 and the highly-heat-conductive member 32 are disposed in contact with each other. This also applies to FIGS. 10A to 13C described later.

In the longitudinal direction, in the portions in which the openings are disposed in the nip formation pad 31, the highly-heat-conductive member 32 is pressed against the fixing nip N in a non-contact state with the nip formation pad 31 and becomes in a pressed state. Accordingly, if the highly-heat-conductive member 32 is a member that is easily deformed or the width of the second opening portion 43 is large, the highly-heat-conductive member 32 might be deflected at the portions.

Figure 7A:
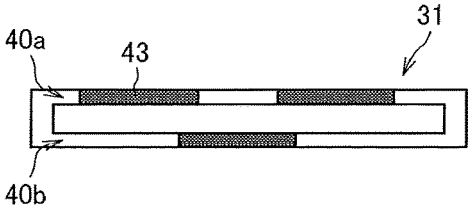
FIG. 7A is a plan view of a nip formation pad according to an embodiment of the present disclosure.
Figure 7B:
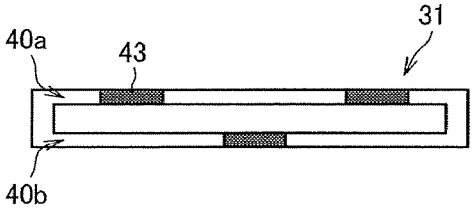
FIG. 7B is a plan view of a nip formation pad according to an embodiment of the present disclosure.

Accordingly, it is preferable to change the number and the width of the second opening portions 43 depending on the rigidity of the highly-heat-conductive member 32 and the nip surface pressure. For example, as illustrated in FIG. 7A, in a fixing device having a configuration with high rigidity and less deflective of the highly-heat-conductive member 32 and a configuration with a low nip surface pressure at the fixing nip N, a large width of the second opening portion 43 can be used. Alternatively, the second opening portions 43 disposed in the downstream abutment area 40*a* and the upstream abutment area 40*b* can be partially overlapped in the longitudinal direction of the nip formation pad 31. Such a configuration can reduce the contact area between the highly-heat-conductive member 32 and the nip formation pad 31, and the heat transfer from the highly-heat-conductive member 32 to the nip formation pad 31 can be further suppressed. On the contrary, in a fixing device having a configuration with low rigidity of the highly-heat-conductive member 32 and a configuration with high nip surface pressure at the fixing nip N, as illustrated in FIG. 7B, the width of the second opening portion 43 is reduced or the number of the second opening portions 43 is reduced to ensure a contact area between the nip formation pad 31 and the highly-heat-conductive member 32 and to prevent deflection of the highly-heat-conductive member 32.

Figure 8A:
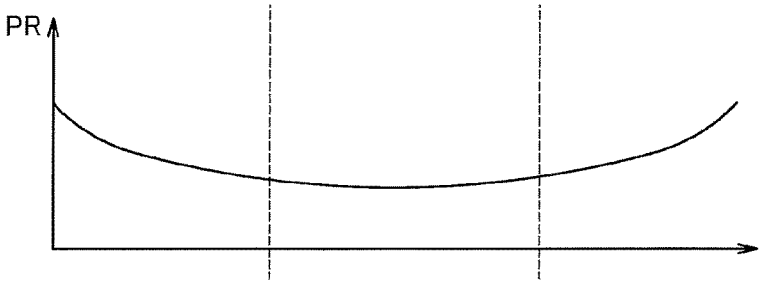
FIGS. 8A and 8B are diagrams of relationship between distribution of nip surface pressure and arrangement of second opening portions of a nip formation pad according to an embodiment of the present disclosure.
Figure 8B:
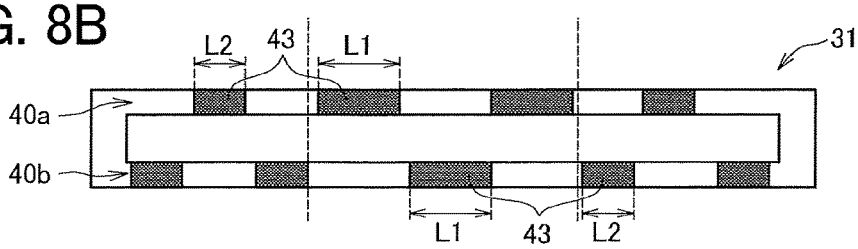

Further, the second opening portions 43 may have different widths. For example, in the nip formation pad 31 of the embodiment illustrated in FIGS. 8A and 8B, the width of the second opening portion 43 is changed according to the nip surface pressure PR of the fixing nip N in the longitudinal direction.

More specifically, in the fixing device of this embodiment, the nip surface pressure PR at the fixing nip N is smaller at the center side in the longitudinal direction than at the end side. Correspondingly, the width L1 of the second opening portion 43 in the longitudinal center side (an area between dotted lines in FIGS. 8A and 8B) is greater than the width L2 of the second opening portion 43 in longitudinal end sides (areas outside the dotted lines in FIGS. 8A and 8B). That is, in a portion in which the nip surface pressure PR is large, the contact area between the nip formation pad 31 and the highly-heat-conductive member 32 is secured, and a larger opening area is secured in a portion in which the nip surface pressure PR is small. Such a configuration can reduce the transfer of heat from the highly-heat-conductive member 32 to the nip formation pad 31 as much as possible while preventing deflection of the highly-heat-conductive member 32.

Figure 9A:
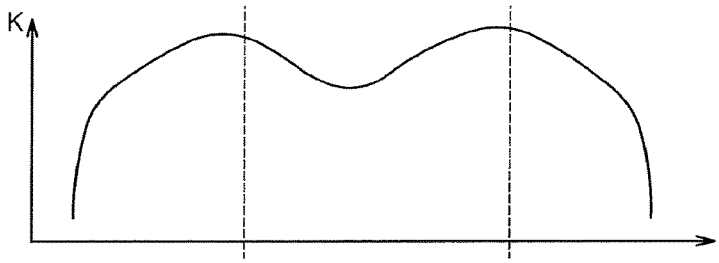
FIGS. 9A and 9B are diagrams of relationship between heat distribution amount of a heat source and arrangement of second opening portions of a nip formation pad according to an embodiment of the present disclosure.
Figure 9B:
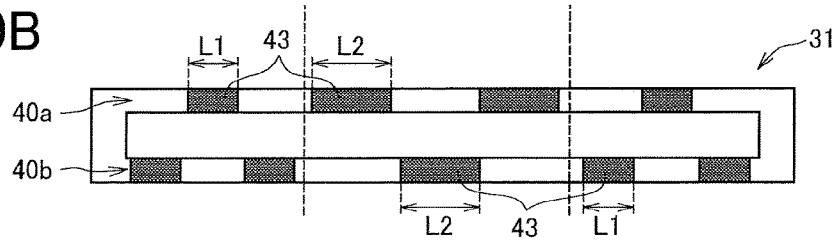

In the nip formation pad 31 having the structure illustrated in FIGS. 9A and 9B, the width of the second opening portion 43 is changed in accordance with the heat distribution amount K of the heater (the heater 34*a* and the heater 34*b*, see FIG. 2) in the longitudinal direction. For example, as illustrated in FIGS. 9A and 9B, in the fixing device 7 of the present embodiment, the heat distribution amount K of the heater is smaller at the center side in the longitudinal direction than at the end side. Corresponding to such a configuration, the width L1 of the second opening portion 43 at the center side in the longitudinal direction is greater than the width L2 of the second opening portion 43 on the end side in the longitudinal direction. That is, since the temperature of the fixing belt 22 is less likely to rise in a portion in which the heat distribution amount K is small, a large width of the second opening portion 43 is set in the portion. Such a configuration can reduce the amount of heat transfer from the highly-heat-conductive member 32 to the nip formation pad 31, thus facilitating the temperature rise of the fixing belt 22 in the portion. The temperature distribution of the fixing belt 22 in the longitudinal direction can be leveled.

Further, not only the width but also the depth of the second opening portion 43 may be changed. For example, in the nip formation pad 31 of the embodiment illustrated in FIGS. 10A to 10C, the depth of the second opening portion 43 is changed in accordance with the nip surface pressure PR of the fixing nip N in the longitudinal direction.

Figure 10A:
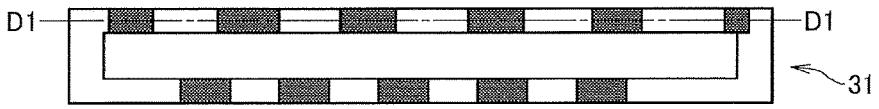
FIGS. 10A, 10B, and 10C are diagrams of relationship between distribution of nip surface pressure and depth of second opening portions of a nip formation pad according to an embodiment of the present disclosure.
Figure 10B:
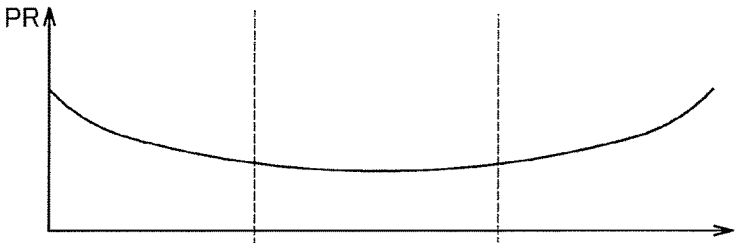
Figure 10C:
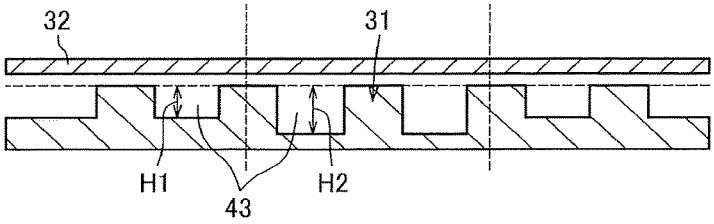

In other words, the greater the depth of the second opening portion 43, the thinner the nip formation pad 31 and the lower the strength of the nip formation pad 31. On the other hand, the thickness of a heat insulation layer formed between the highly-heat-conductive member 32 and the nip formation pad 31 increases, and the heat insulating effect increases. Accordingly, in the fixing device 7 of the present embodiment, as illustrated in FIGS. 10A to 10C, the depth H1 of the second opening portion 43 is decreased on both end sides in the longitudinal direction in which the nip surface pressure PR is large, and the depth H2 of the second opening portion 43 is increased on the center side in the longitudinal direction in which the nip surface pressure PR is small. As a result, the strength of the nip formation pad 31 can be secured at a position at which the nip surface pressure PR is large, and a larger heat insulating effect can be obtained at a position at which the nip surface pressure PR is small. As described above, in the present embodiment, it is possible to achieve both the strength of the nip formation pad 31 and the effect of suppressing the heat transfer from the highly-heat-conductive member 32 to the nip formation pad 31.

Figure 11A:
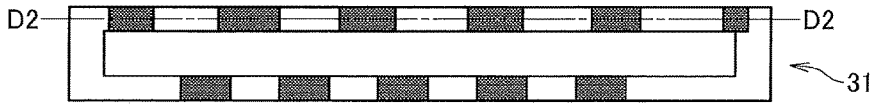
FIGS. 11A, 11B, and 11C are diagrams of relationship between heat distribution amount of a heat source and depth of second opening portions of a nip formation pad according to an embodiment of the present disclosure.
Figure 11B:
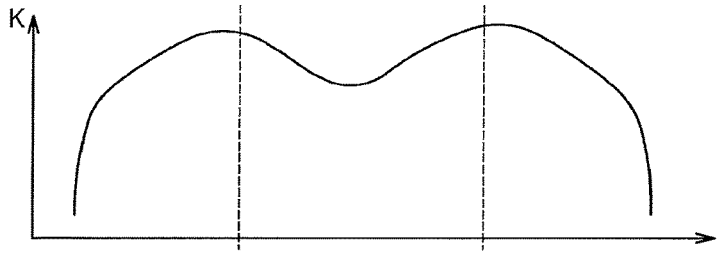
Figure 11C:
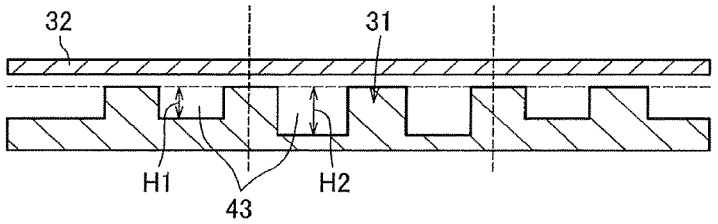

In the nip formation pad 31 according to an embodiment illustrated in FIGS. 11A to 11C, the depth of the second opening portion 43 is changed according to the heat distribution amount K of the heater. In other words, the depth of the second opening portion 43 is increased in a portion in which the heat distribution amount K of the heater in the longitudinal direction is small. Such a configuration can reduce the amount of heat transfer from the highly-heat-conductive member 32 to the nip formation pad 31, thus enhancing the performance of temperature rise of the fixing belt 22. For example, as illustrated in FIGS. 11A, 11B, and 11C, the depth H1 of the second opening portion 43 is small on the longitudinal end sides having a large heat distribution amount K, and the depth H2 of the second opening portion 43 is large on the longitudinal center side having a small heat distribution amount K. Such a configuration can facilitate the temperature rise of the fixing belt 22 on the center side in the longitudinal direction and level the temperature distribution of the fixing belt 22 in the longitudinal direction.

Figure 12A:
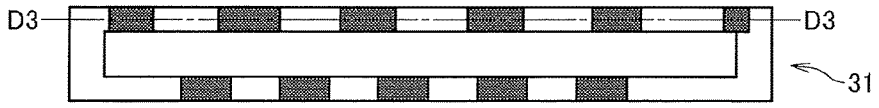
FIG. 12A is a plan view of a nip formation pad according to an embodiment of the present disclosure.
Figure 12B:
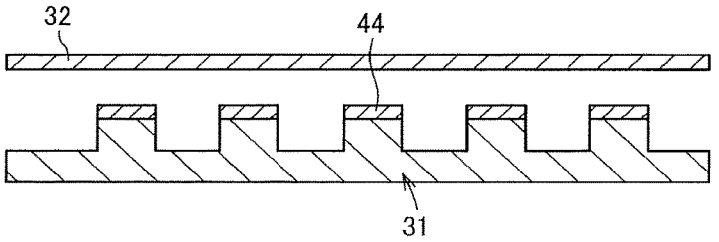
FIG. 12B is a cross sectional view of the nip formation pad cut along line D3-D3 in FIG. 12A.

In the nip formation pad 31 according to an embodiment illustrated in FIGS. 12A and 12B, a heat insulator 44 is disposed on an abutment surface of the nip formation pad 31 that contacts the highly-heat-conductive member 32. The heat insulator 44 is made of, for example, a highly heat insulating material, such as urethane foam.

In the present embodiment, the nip formation pad 31 abuts the highly-heat-conductive member 32 via the heat insulator 44. Such a configuration can further reduce the amount of heat transfer from the highly-heat-conductive member 32 to the nip formation pad 31.

Figure 13A:
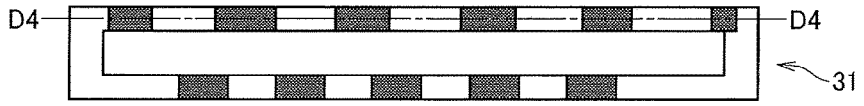
FIGS. 13A, 13B, and 13C are diagrams of relationship between nip surface pressure and thickness of a heat insulator according to an embodiment of the present disclosure.
Figure 13B:
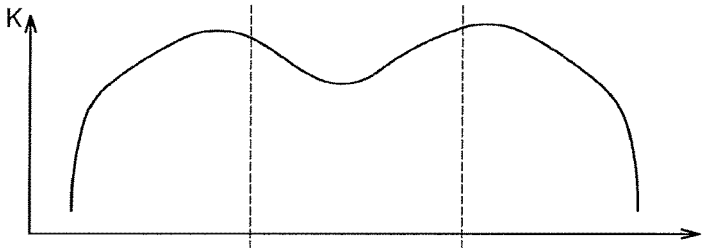
Figure 13C:
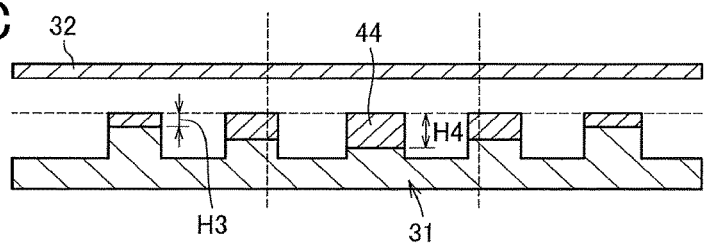

Further, the thickness of the heat insulator 44 may be changed according to the magnitude of the heat distribution amount K of the heater. That is, in a portion in which the heat distribution amount K is small in the longitudinal direction, the amount of heat received by the fixing belt 22 is small and the temperature of fixing belt 22 is less likely to rise. Hence, by increasing the thickness of the heat insulator 44 in such a portion and reducing the amount of heat transfer from the highly-heat-conductive member 32 to the nip formation pad 31, the temperature of the fixing belt 22 can be easily increased in such a portion. More specifically, as illustrated in FIGS. 13A to 13C, the thickness H3 of the heat insulator 44 is set to be large on the longitudinal end sides in which the heat distribution amount K is large, and the thickness H4 of the heat insulator 44 is set to be small on the longitudinal center side in which the heat distribution amount K is large. Such a configuration can facilitate the temperature rise of the fixing belt 22 on the longitudinal center side, in which the heat distribution amount K is small, and level the temperature distribution of the fixing belt 22 in the longitudinal direction.

Further, as in the embodiments illustrated in FIGS. 8A through 10C, the thickness of the heat insulator 44 may be changed according to the magnitude of the nip surface pressure PR in the longitudinal direction.

The present disclosure is not limited to the details of the embodiments described above and various modifications and improvements are possible.

For example, an image forming apparatus according to an embodiment of the present disclosure is not limited to the image forming apparatus 1 illustrated in FIG. 1 as a color printer. In some embodiments, the image forming apparatus may be a monochrome printer, a copier, a facsimile machine, a multifunction peripheral, or the like.

The sheet P serving as a recording medium may be thick paper, postcard, envelope, plain paper, thin paper, coated paper, art paper, tracing paper, overhead projector (OHP) transparency, plastic film, prepreg, copper foil, or the like.

What is claimed is:

1. A fixing device, comprising:

an endless fixing belt;

a heat source to heat the fixing belt;

an opposed member disposed at an outer circumferential surface side of the fixing belt and opposed to the fixing belt;

a nip formation pad disposed at an inner circumferential surface side of the fixing belt, to form a fixing nip between the fixing belt and the opposed member; and a heat conductive member disposed between the nip formation pad and the fixing belt, the heat conductive member having a first face abutting the nip formation pad and a second face abutting an inner circumferential surface of the fixing belt, the nip formation pad including:

an abutment region including a plurality of abutment surfaces that abuts the first face of the heat conductive member; and a first opening portion disposed at a center of the abutment region to form a non-contact area at which the nip formation pad does not contact the heat conductive member, the abutment region including:

an upstream abutment area disposed at an upstream side from the first opening portion in a direction of conveyance of a recording medium; and a downstream abutment area disposed at a downstream side from the first opening portion in the direction of conveyance of the recording medium; and a plurality of second opening portions divides at least one area of the upstream abutment area and the downstream abutment area into a plurality of portions in a longitudinal direction of the nip formation pad, wherein, in the longitudinal direction of the nip formation pad, a range in which the plurality of second opening portions is disposed in the upstream abutment area does not overlap a range in which the plurality of second opening portions is disposed in the downstream abutment area.

2. The fixing device according to claim 1, wherein, in the longitudinal direction of the nip formation pad, the plurality of second opening portions is alternately disposed in the upstream abutment area and the downstream abutment area.

3. The fixing device according to claim 1, wherein the plurality of second opening portions is disposed at a plurality of positions in the longitudinal direction of the nip formation pad, and wherein the plurality of second opening portions has different widths that vary according to a change in nip surface pressure in a longitudinal direction of the fixing nip.

4. A fixing device, comprising:

an endless fixing belt;

a heat source to heat the fixing belt;

an opposed member disposed at an outer circumferential surface side of the fixing belt and opposed to the fixing belt;

a nip formation pad disposed at an inner circumferential surface side of the fixing belt, to form a fixing nip between the fixing belt and the opposed member; and a heat conductive member disposed between the nip formation pad and the fixing belt, the heat conductive member having a first face abutting the nip formation pad and a second face abutting an inner circumferential surface of the fixing belt, the nip formation pad including:

an abutment region including a plurality of abutment surfaces that abuts the first face of the heat conductive member; and a first opening portion disposed at a center of the abutment region to form a non-contact area at which the nip formation pad does not contact the heat conductive member, the abutment region including:

an upstream abutment area disposed at an upstream side from the first opening portion in a direction of conveyance of a recording medium; and a downstream abutment area disposed at a downstream side from the first opening portion in the direction of conveyance of the recording medium; and a plurality of second opening portions divides at least one area of the upstream abutment area and the downstream abutment area into a plurality of portions in a longitudinal direction of the nip formation pad, wherein the plurality of second opening portions is disposed at a plurality of positions in the longitudinal direction of the nip formation pad, and wherein the plurality of second opening portions has different widths that vary according to a change in heat distribution amount in a longitudinal direction of the heat source.

5. The fixing device according to claim 1, wherein the plurality of second opening portions is disposed at a plurality of positions in the longitudinal direction of the nip formation pad, and wherein the plurality of second opening portions has different depths that vary according to a change in nip surface pressure in a longitudinal direction of the fixing nip.

6. A fixing device, comprising:

an endless fixing belt;

a heat source to heat the fixing belt;

an opposed member disposed at an outer circumferential surface side of the fixing belt and opposed to the fixing belt;

a nip formation pad disposed at an inner circumferential surface side of the fixing belt, to form a fixing nip between the fixing belt and the opposed member; and a heat conductive member disposed between the nip formation pad and the fixing belt, the heat conductive member having a first face abutting the nip formation pad and a second face abutting an inner circumferential surface of the fixing belt, the nip formation pad including:

an abutment region including a plurality of abutment surfaces that abuts the first face of the heat conductive member; and a first opening portion disposed at a center of the abutment region to form a non-contact area at which the nip formation pad does not contact the heat conductive member, the abutment region including:

an upstream abutment area disposed at an upstream side from the first opening portion in a direction of conveyance of a recording medium; and a downstream abutment area disposed at a downstream side from the first opening portion in the direction of conveyance of the recording medium; and a plurality of second opening portions divides at least one area of the upstream abutment area and the downstream abutment area into a plurality of portions in a longitudinal direction of the nip formation pad, wherein the plurality of second opening portions is disposed at a plurality of positions in the longitudinal direction of the nip formation pad, and wherein the plurality of second opening portions has different depths that vary according to a change in heat distribution amount in a longitudinal direction of the heat source.

7. The fixing device according to claim 1, further comprising a heat insulator disposed on the plurality of abutment surfaces of the nip formation pad.

8. The fixing device according to claim 7, wherein the heat insulator has different thicknesses that vary according to a change in nip surface pressure in a longitudinal direction of the fixing nip.

9. An image forming apparatus comprising the fixing device according to claim 1.

* * * * *